US011585522B2

(12) United States Patent
Martin et al.

(10) Patent No.: US 11,585,522 B2
(45) Date of Patent: Feb. 21, 2023

(54) LED LIGHTING DEVICE

(71) Applicant: SIGNIFY HOLDING B.V., Eindhoven (NL)

(72) Inventors: Genevieve Martin, Udenhout (NL); Jianghong Yu, Best (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/431,603

(22) PCT Filed: Feb. 17, 2020

(86) PCT No.: PCT/EP2020/054024

§ 371 (c)(1),
(2) Date: Aug. 17, 2021

(87) PCT Pub. No.: WO2020/173731

PCT Pub. Date: Sep. 3, 2020

(65) Prior Publication Data

US 2022/0136689 A1 May 5, 2022

(30) Foreign Application Priority Data

Feb. 27, 2019 (EP) ..... 19159692

(51) Int. Cl.
*F21V 29/51* (2015.01)
*F21K 9/23* (2016.01)
(Continued)

(52) U.S. Cl.
CPC ..... *F21V 29/51* (2015.01); *F21K 9/23* (2016.08); *F21Y 2107/30* (2016.08); *F21Y 2115/10* (2016.08)

(58) Field of Classification Search
CPC ..... F21V 29/51; F21K 9/23; F21Y 2107/30
See application file for complete search history.

(56) References Cited

U.S. PATENT DOCUMENTS 5,329,438 A * 7/1994 Thompson ..... F21S 8/086 362/296.08
2007/0079954 A1 4/2007 Wang et al.
(Continued)

FOREIGN PATENT DOCUMENTS

JP 2017112087 A 6/2017
WO 2008093978 A1 8/2008
WO 201517038 A1 11/2015

*Primary Examiner* — Karabi Guharay

(57) ABSTRACT

The invention provides a lighting device (100) comprising a vapor chamber unit (200), a heat sink (300), and a plurality of light sources (10), wherein: the vapor chamber unit (200) comprises a vapor chamber (210) defined by at least a first plate (211) and a second plate (212) having an average plate distance (d1), wherein the vapor chamber (210) comprises a first A chamber end (221) and a second chamber end (222) defining a chamber length (L1), wherein the vapor chamber unit (200) comprises (i) a first external face (231) defined by at least part of the first plate (211), wherein the first external face (231) is convex, and (ii) a second external face (232) defined by at least part of the second plate (212); the heat sink (300) is thermally coupled to the vapor chamber unit (200); and the light sources (10) are configured to generate light source light.

15 Claims, 4 Drawing Sheets

(51) Int. Cl.
*F21Y 115/10* (2016.01)
*F21Y 107/30* (2016.01)

(56) References Cited

U.S. PATENT DOCUMENTS

| | | | | |
|---|---|---|---|---|
| 2009/0021944 | A1 | 1/2009 | Guang et al. | |
| 2010/0141108 | A1 | 6/2010 | Liu et al. | |
| 2010/0225217 | A1 | 9/2010 | Liu | |
| 2011/0043092 | A1 | 2/2011 | Shuja et al. | |
| 2011/0069500 | A1 | 3/2011 | Meyer et al. | |
| 2014/0078737 | A1* | 3/2014 | Lin | F21V 29/717<br>362/249.02 |
| 2018/0156441 | A1* | 6/2018 | Wang | F21V 29/713 |

* cited by examiner

LED LIGHTING DEVICE

CROSS-REFERENCE TO PRIOR APPLICATIONS

This application is the U.S. National Phase application under 35 U.S.C. § 371 of International Application No. PCT/EP2020/054024, filed on Feb. 17, 2020, which claims the benefit of European Patent Application No. 19159692.3, filed on Feb. 27, 2019. These applications are hereby incorporated by reference herein.

FIELD OF THE INVENTION

The invention relates to a lighting device, especially a (HID-type) LED lighting device. The invention further relates to module comprising such lighting device. Yet further, the invention also relates to luminaire, such as a street lighting luminaire, comprising such lighting device (or such module).

BACKGROUND OF THE INVENTION

LED lamps with heat dissipating apparatus for supporting and cooling an LED module are known in the art. US2009/0021944, for instance, describes an LED lamp comprising: a bulb; an LED module comprising a plurality of LEDs received in the bulb; a heat dissipation apparatus supporting and cooling the LED module, the heat dissipation device comprising: a heat sink having a hollow base and a plurality of fins mounted on the base; a hollow first heat conductor supported by the heat sink; and a heat transfer device having a container defining a vacuum space receiving a phase-changeable working fluid therein, being retained in the heat sink and the first heat conductor in such a manner that an outer periphery surface of the heat transfer device is tightly enclosed by the base and the first heat conductor; wherein the LEDs are distributed on the first heat conductor.

US 2011/069500 A1 discloses a heat dissipation module for a bulb type light emitting diode (LED) lamp. The heat dissipation module for a bulb type LED lamp comprises: (i) a heat dissipation assembly comprising a cylinder, a central hole being provided in the cylinder, the central hole tapering off inwards to form two corresponding inclined surfaces; and (ii) a heat conducting element, being of a sheet shape, accommodated in the central hole, and having a heat-absorbing section and two heat-releasing sections extending from the heat-absorbing section and being in contact with the inclined surfaces.

SUMMARY OF THE INVENTION

For street lighting, often HID-based lamps are used. HID-based lamps (or "HID lamps") are high intensity discharge lamps. For instance, for street lighting high pressure sodium vapor lamps may be applied. Such lamps may comprise in embodiments a polycrystalline translucent aluminum oxide discharge tube enclosed in in general an ovoid or tubular outer glass envelope. The avoid shell of the HID lamps may be internally coated with aluminum oxide powder. The discharge tube may in general contain an amalgam of mercury and sodium along with a noble gas such as neon and or xenon. HID lamps are known in the art.

HID based lamps may be replaced by LED based lamps or other solid state light source based lamps. The LEDs may need ballast and cooling elements, which may make the lighting device with the LED(s) relatively heavy. As in street lighting applications the module with the lighting device may be subject to vibrations (traffic based air movements, wind, etc.), the lighting device may vibrate out of a socket, which is of course undesirable. The more power desired, the heavier the lighting device gets, and the larger the risk of vibration related undesired artefacts.

Hence, it is an aspect of the invention to provide an alternative lighting device (or module comprising such lighting device, or (street) lamp comprising such lighting device or module), which preferably further at least partly obviates one or more of above-described drawbacks. The present invention may have as object to overcome or ameliorate at least one of the disadvantages of the prior art, or to provide a useful alternative.

In a first aspect, the invention provides a lighting device ("device") comprising a vapor chamber unit, (optionally a heat sink,) and one or more light sources, especially a plurality of light sources, wherein: (A) the vapor chamber unit comprises a vapor chamber ("chamber") defined by at least a first plate and a second plate having an average plate distance (d1), wherein in specific embodiments the vapor chamber comprises a first chamber end and a second chamber end defining a chamber length (L1), wherein the vapor chamber unit comprises (i) a first external face defined by at least part of the first plate, wherein in further specific embodiments the first external face is convex, and (ii) a second external face defined by at least part of the second plate; and (B) the one or more light sources, especially the plurality of light sources, are configured to generate light source light, and wherein the one or more light sources, especially the plurality of light sources, are associated with the first external face. Further, (C) the optional heat sink may be thermally coupled to the vapor chamber unit.

When using a vapor chamber, the lighting device may be relatively light-weight while nevertheless heat can be transported away from the light source(s) to the (optional) heat sink. The use of the vapor chamber also allows using a hollow support for the light source(s). Hence, a hollow support may be provided by the (shaped) vapor chamber. This also allows a relatively light-weight support for the one or more light sources while nevertheless heat can be transported away from the light source(s) to the (optional) heat sink. Further, this also allows positioning light sources at different positions on the (light-weight) support for creating the desired beam shape and/or for creating an essentially omni-directional light source. Hence, in this way a (retrofit) HID-type LED lighting device may be provided.

As indicated above, the invention provides in embodiments a lighting device comprising a vapor chamber unit, and one or more light sources, especially a plurality of light sources. This lighting device can be configured retrofit for HID lamps, and may thereby be used for replacing existing HID lamps in e.g. street lighting applications. For instance, the lighting device may include a connector configured to be functionally coupled to a socket, such as an Edison screw, a bayonet mount, etc.

The term "light source" may refer to a semiconductor light-emitting device, such as a light emitting diode (LEDs), a resonant cavity light emitting diode (RCLED), a vertical cavity laser diode (VCSELs), an edge emitting laser, etc. The term "light source" may also refer to an organic light-emitting diode, such as a passive-matrix (PMOLED) or an active-matrix (AMOLED). In a specific embodiment, the light source comprises a solid state light source (such as a LED or laser diode). In an embodiment, the light source comprises a LED (light emitting diode). The term LED may also refer to a plurality of LEDs. Further, the term "light source" may in embodiments also refer to a so-called chips-on-board (COB) light source. The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module. The term "light source" may also relate to a plurality of (essentially identical (or different)) light sources, such as 2-2000 solid state light sources. In embodiments, the light source may comprise one or more micro-optical elements (array of micro lenses) downstream of a single solid state light source, such as a LED, or downstream of a plurality of solid state light sources (i.e. e.g. shared by multiple LEDs). In embodiments, the light source may comprise a LED with on-chip optics. In embodiments, the light source comprises a pixelated single LEDs (with or without optics) (offering in embodiments on-chip beam steering).

The phrases "different light sources" or "a plurality of different light sources", and similar phrases, may in embodiments refer to a plurality of solid state light sources selected from at least two different bins. Likewise, the phrases "identical light sources" or "a plurality of same light sources", and similar phrases, may in embodiments refer to a plurality of solid state light sources selected from the same bin.

Hence, in embodiments the plurality of light sources comprises solid state light sources.

In embodiments, the light source(s) comprise a LED strip. Such LED strip(s) may directly be attached to the first external surface.

The vapor chamber unit may thus be configured as support for the one or more light sources.

The one or more light sources, especially the plurality of light sources, are configured to generate light source light. Especially, the light source(s) are configured to generate visible light. In specific embodiments, the light source(s) are configured to generate white light, though other types of visible light may also be possible. The terms "visible", "visible light" or "visible emission" and similar terms refer to light having one or more wavelengths in the range of about 380-780 nm. The term "white light" herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL. For street lighting, the CCT may e.g. be selected from the range of about 2000-6000 K, such as 3000-4500 K.

In alternative embodiments, the lighting device may be configured to generate colored radiation, e.g. for horticulture, agriculture, or fish farming, etc.

In alternative embodiments, the lighting device may be configured to generate essentially UV radiation, e.g. for disinfection purposes. In alternative embodiments, the lighting device may be configured to generate essentially IR radiation, e.g. for heating, or horticulture, etc.

The lighting device is configured to generate lighting device light, which may essentially consist of the light source light of the one or more light sources. The lighting device light may be controllable in intensity and/or directionality and/or shape. The latter two options may especially be the case(s) when there is a plurality of light sources of which two or more have optical axes that are not configured parallel. This may e.g. be achieved by arranging the light sources at different positions on a shaped vapor chamber unit.

Further, especially when more than one light source is applied, the lighting device light may be controllable in one or more of color point, color temperature, color rendering index, etc. Hence, the lighting device may also comprise or may be functionally coupled to a control system. In embodiments, the control system may be a slave control system, configured to control a subset of a plurality of lighting devices (such as a control system for controlling a plurality of street lighting luminaires in a single street or a couple of streets), while a (central) master control system may be configured to control such slave system. Or, in other embodiments, there may be a single (remote) control system. Yet further embodiments may also be possible.

The term "controlling" and similar terms especially refer at least to determining the behavior or supervising the running of an element. Hence, herein "controlling" and similar terms may e.g. refer to imposing behavior to the element (determining the behavior or supervising the running of an element), etc., such as e.g. measuring, displaying, actuating, opening, shifting, changing temperature, etc. Beyond that, the term "controlling" and similar terms may additionally include monitoring. Hence, the term "controlling" and similar terms may include imposing behavior on an element and also imposing behavior on an element and monitoring the element. The controlling of the element can be done with a control system, which may also be indicated as "controller". The control system and the element may thus at least temporarily, or permanently, functionally be coupled. The element may comprise the control system. In embodiments, the control system and element may not be physically coupled. Control can be done via wired and/or wireless control. The term "control system" may also refer to a plurality of different control systems, which especially are functionally coupled, and of which e.g. one control system may be a master control system and one or more others may be slave control systems. A control system may comprise or may be functionally coupled to a user interface.

The system, or apparatus, or device may execute an action in a "mode" or "operation mode" or "mode of operation". Likewise, in a method an action or stage, or step may be executed in a "mode" or "operation mode" or "mode of operation". The term "mode" may also be indicated as "controlling mode". This does not exclude that the system, or apparatus, or device may also be adapted for providing another controlling mode, or a plurality of other controlling modes. Likewise, this may not exclude that before executing the mode and/or after executing the mode one or more other modes may be executed.

However, in embodiments a control system may be available, that is adapted to provide at least the controlling mode. Would other modes be available, the choice of such modes may especially be executed via a user interface, though other options, like executing a mode in dependence of a sensor signal or a (time) scheme, may also be possible. The operation mode may in embodiments also refer to a system, or apparatus, or device, that can only operate in a single operation mode (i.e. "on", without further tunability). Hence, in embodiments, the control system may control in dependence of one or more of an input signal of a user interface, a sensor signal (of a sensor), and a timer. The term "timer" may refer to a clock and/or a predetermined time scheme.

As indicated above, the lighting device comprises a vapor chamber unit. The vapor chamber unit comprises a vapor chamber and optionally other elements. Vapor chambers are known in the art and may be based on essentially the same principle as heat pipes (which are also known in the art). Both systems are known as "two-phase devices". Both two-phase devices may include a wick structure (sintered powder, mesh screens, and/or grooves) applied to the inside wall(s) of an enclosure (tube or planar shape). Liquid, such as water (for copper device) or acetone (e.g. for aluminum device), is added to the device and the device is vacuum sealed. The wick may distribute the liquid throughout the device. However, when heat is applied to one area of the two-phase device, the liquid turns to vapor and moves to an area of lower pressure where it cools and returns to liquid form whereupon it moves back to the heat source by virtue of capillary action. A common wick structure is a sintered wick type because it offers a high degree of versatility in terms of power handling capacity and ability to work against gravity. Mesh screen wicks may allow the heat pipe or vapor chamber to be thinner relative to a sintered wick. Also, a grooved wick may be applied. The grooves may act as an internal fin structure aiding in the evaporation and condensation. A difference between the heat pipe and the vapor chamber may be that the heat pipe may have an essentially rod-shaped shape, whereas the vapor chamber may in general include two essentially planar plates at a relative short distance (such as up to 5 mm), with optionally spacers in between. Further, for the vapor chamber the hot spot may relatively freely be chosen, whereas for a heat pipe there is a hot and cold side.

In the present invention, the vapor chamber may be essentially flat. However, in other embodiments especially the vapor chamber has a convex shape, with the light source(s) associated to the convex surface thereof. This also allows creating a lighting device with may provide light in many or essentially all directions. Hence, in embodiments the vapor chamber unit may have a convex shape.

Hence, in specific embodiments the vapor chamber is defined by at least a first plate and a second plate having an average plate distance (d1). At the edges of the plate, the plates may be welded together to provide a closed chamber. The plates may also define, together with one or more edges, the vapor chamber. In embodiments, over a substantial part of the first plate and a substantial part of the second plate, the plates may be configured parallel. For instance, over at least 50%, such as at least 80%, like at least 90% of an area of the first plate, and over at least 50%, such as at least 80%, like at least 90% of an area of the second plate, the plates may be configured parallel. Hence, over a substantial part of the first plate and a substantial part of the second plate, the distance between the plates may essentially not vary. The average plate distance (d1) is defined as the average distance between the first and the second plates.

In specific embodiments, the average plate distance (d1) is selected from the range of 50 μm-5 mm. In embodiments, the average plate distance may be at maximum 1 mm. The average plate distance may even be equal to or smaller than 0.4 mm, e.g. in the range of 100-400 μm, like 200-400 μm, such as at least 250 μm.

In embodiments, the first plate and a second plate each have a second thickness (d2) independently selected from the range of 50-5000 μm, such as 100-2000 μm, like especially 300-2000 μm. The phrase "independently selected" and similar phrases may refer to embodiments wherein for the relevant elements the same value of the parameter is chosen, i.e. in these embodiments both plates may have the same thickness, but may also refer to embodiments wherein for the relevant elements different values of the parameter is chosen, i.e. in these embodiments both plates may have a thickness selected from the indicated range, but they may have different thicknesses. Further, in embodiments the second thickness(es) may also vary over the first plate and/or the second plate.

The vapor chamber comprises a first chamber end and a second chamber end defining a chamber length (L1). In general, the chamber will have a length and a width that are substantially larger than the average plate distance. Further, in general, the vapor chamber will have a cross-section which is essentially rectangular. As the vapor chamber may have a convex shape, a projection of the vapor chamber on a plane may in embodiments have an essentially rectangular shape. The vapor chamber, or the vapor chamber unit, may have an axis of elongation. The axis of elongation may be an axis along which the length of the vapor chamber may be defined. The axis of elongation may be within the plane on which the vapor chamber may be projected. For instance, assume the vapor chamber to have a cylindrical shape, the axis of elongation of the cylinder may be the cylinder axis and a projection of the cylinder on a plane, wherein the cylinder axis is configured, may provide a (essentially rectangular) cross-sectional shape. Hence, the width of the vapor chamber may in embodiments be a circumference (2*D), as a convex vapor chamber may be seen as a flat vapor chamber that has been bent to be convex.

Further, in general the chamber height (or distance) may also be much smaller than the length and/or width of the vapor chamber. Hence, in specific embodiments the chamber length (L1) and the average plate distance (d1) have a ratio selected from the range of L1/d1≥10, such as ≥20, like selected from the range of 10-10,000. Alternatively or additionally, in specific embodiments the chamber width (W1) and the average plate distance (d1) have a ratio selected from the range of W1/d1≥10, such as ≥20, like selected from the range of 10-10,000.

In embodiments, the chamber length L1 may e.g. be selected from the range of 1-50 cm, such as 2-40 cm, like selected from the range of 2-20 cm, such as in the range of 4-15 cm, e.g. 5-12 cm. Likewise, this may apply to the chamber width (or circumference), though in embodiments the chamber width may be smaller than the chamber length.

The vapor chamber unit comprises (i) a first external face defined by at least part of the first plate. Hence, a plate, which may be planar or which may be curved, may provide a first external face. Another plate, the second plate, may provide a second external surface. Hence, the vapor chamber unit may also comprise second external face defined by at least part of the second plate. Referring to the embodiment of the cylinder, the first plate and the second plate may be both cylindrical, with the former having a larger internal diameter than the outer diameter of the latter, such that a space is defined between the cylindrical plates. At the edges of the cylinder, the plates may be welded together, or otherwise closed.

As indicated above, the first external face may in embodiments be planar. Especially however, the first external face may in (other) embodiments be convex. In view of the above, the second external face may thus also be convex. Here, the term "convex" is applied, as the light source(s) may be configured associated to the first external face. For these one or more light sources, the first external face is convex. In embodiments, seen from the axis of elongation, the first external face and the second external face may be perceived concave.

Hence, in specific embodiments the first external face is convex, and the one or more light sources, especially the plurality of light sources, are associated with the first external face. The term "associated" especially indicates that the light sources are physically coupled to the first external face. As in embodiments the first plate (and the second plate) may comprise a metal, the light sources may be associated to a flexible PCB or a rigid PCB, or a flex-rigid PCB, which is associated to the first external face. In embodiments, the LEDs (and optionally sensors) may be arranged on a flexible PCB. In embodiments, the flexible PCB may comprise polyimide or a metal e.g. copper. In case the flexible PCB comprises a metal (carrier) e.g. copper (carrier), the metal (carrier) may be soldered to the vapor chamber. In this way the thermal management is improved. Other electronics such as a driver and/or controller may be arranged inside the vapor chamber. Other electronics such as a driver and/or a controller may be arranged on a flexible PCB which may comprise polyimide or a metal (carrier) e.g. copper (carrier). In case the flexible PCB comprises a metal e.g. a copper (carrier), the metal (carrier) may be soldered to the inner side of the vapor chamber. In this way the thermal management is improved. In embodiments, copper-based PCB is bendable and conformable and can be directly soldered to the vapor chamber heat sink housing. The flexible PCB may also comprise a polyimide layer with electrically conductive tracks and a copper layer, where the LEDs are arranged on the polyimide layer with the electrically conductive tracks and the copper layer is soldered to the vapor chamber. In embodiments, a LED strip may be associated with the first external face. Association may be via physical means, like clamping, screws, etc., or other means, like glue, adhesive, welding, etc. etc. This is known to a person skilled in the art.

In embodiments, the light sources are associated to a flexible PCB which is associated to the first external face.

In embodiments, the flexible PCB comprises a metal carrier, wherein the metal carrier is soldered to the first external face.

Especially, the light source(s) and the first plate are thermally coupled. Hence, they may be in physical contact, or there may be a thermally conductive material in between, or the distance between the light source(s) and the first plate is equal to or less than 100 μm, such as equal to or less than 50 μm, like equal to or less than 20 μm. For instance, a flexible printed circuit board may have a thickness selected from the range of 15-100 μm.

In specific embodiments, the lighting device may further comprise a heat sink. The term "heat sink" (or "heatsink") may especially be defined as a passive heat exchanger that is configured to transfer heat generated by an electronic or a mechanical device to a fluid medium, such as air or a liquid coolant, where it is dissipated away from the device, thereby allowing regulation of the device's temperature. Especially, a heat sink may comprise heat sink fins, which extend from a support. The heat sink and the heat sink fins (comprised by the heat sink) are in embodiments a monolithic body, especially a metal monolithic body.

Hence, the heat sink and the heat sink fins (comprised by the heat sink) may comprise a thermally conductive material, such as having a thermal conductivity of at least 1 W/(mK), even more especially at least 5 W/(mK), such as at least 10 W/(mK), like at least 100 W/(mK), such as even at least 1000 W/(mK). In specific embodiments, the thermally conductive material comprises a metal, such as copper or aluminum, graphite or a ceramic material. Hence, in embodiments the thermally conductive material comprises one or more of a metal, graphite and a ceramic material. A graphite sheet may have an anisotropic thermal conductivity. In the plane of the plate(s) it can have thermal conductivity in the range 100-1000 W/Km and in the direction perpendicular to the graphite sheet material it may be in the range 2-10 W/Km. Herein, we refer to in plane thermal conductivity when we refer to graphite type of materials. In other embodiments the thermally conductive material may comprise a thermally conductive polymer (see also above).

Alternatively or additionally, the heat sink may (also) comprise a vapor chamber (see further also below).

In embodiments, the heat sink may essentially consist of the heat sink fins.

Heat sink fins are known in the art. In embodiments, they may have a thickness selected from the range of 50 μm-5 mm, such as 100 μm-4 mm, like 0.2-2 mm. For instance, in embodiments, the sink fins may have thicknesses of equal to or less than 0.3 mm.

Other dimensions (other than the thickness) of the heat sink fins may be much larger, such as especially a length or a height, which may be at least 10 times, such as in embodiments at least 20 times larger, such as selected from the range of 5-100 mm. The heat sink fins may be configured perpendicular to the axis of elongation, though it is not excluded that they are configured parallel to an axis of elongation. For instance, when configured in an (internal) cavity one or more of the heat sink fins may be configured essentially parallel to the axis of elongation. However, within a plurality of heat sink fins, there may also be two or more subsets with differently configured heat sink fins. In general, heat sink fins have plate-like shapes.

Note that in specific embodiments one or more heat sink fins may also comprise a vapor chamber. In other words, one or more further vapor chambers may be configured as heat sink fins. Such fins may have a larger thickness, such as at least about 300 μm, like at least about 400 μm, or larger, like about 1 mm.

Heat sink fins may in embodiments be essentially flat plates. However, heat sink fins can in principle have essentially any shape, including organic shapes (if applicable).

Hence, in embodiments the first plate and the second plate may each independently be selected to be from copper, aluminum, (stainless) steel, graphite and a ceramic material. Alternatively or additionally, the first plate and/or the second plate may comprise a metal other than copper, aluminum, or stainless steel. Alternatively or additionally, the first plate and/or the second plate may comprise 3D printed material. In embodiments, the first plate and/or the second plate may comprise (3D printed) composite material. Alternatively or additionally, the first plate and/or the second plate may comprise glass or polymeric material. In embodiments, the first plate and/or the second plate may comprise two or more of the afore-mentioned materials. More especially, the first plate and a second plate comprise a material selected from the group consisting of aluminum, copper, and (stainless) steel. The term "material" may in embodiments also refer to a plurality of different materials.

Likewise, the heat sink fins may comprise (or essentially consist) of a heat sink fin material selected from the materials mentioned above in relation to the first plate and the second plate (and/or mentioned explicitly above in relation to the heat sink and the heat sink fins).

The optional heat sink is especially thermally coupled to the vapor chamber unit. This may imply that they may be in physical contact, or there may be a thermally conductive material in between, or the distance between the vapor chamber unit and the heat sink is equal to or less than 100 μm, such as equal to or less than 50 μm, like equal to or less than 20 μm.

The (optional) heat sink may include a cavity ("heat sink cavity"), wherein the vapor chamber unit may partly be hosted. Especially, when cavity and the vapor chamber unit, when partly hosted by the heat sink cavity, they are configured in a transition fit or interference fit. Hence, the heat sink may be configured to host part of the vapor chamber unit, thereby providing thermal coupling with the vapor chamber unit. Especially, part of the first external face is in thermal contact, especially physical contact, with the heat sink. Of course, especially no light sources will be available on the part of the first external face that is hosted in the heat sink cavity. In embodiments, also at least part of the second external face may be in thermal contact, especially physical contact, with the heat sink.

As indicated above, the first external face (and especially thus also the second external face) may be non-planar. Here, the term "non-planar" may refer to curved and/or segmented with segments that are configured under angles, such as especially equal to or larger than 60° and especially smaller than 180°. Hence, above, the term "convex" is applied, which may refer to a curved convex shape or a convex shape provided by segments. For instance, the first external face may have the shape of a cylinder (in fact a single segment), an oval (two segments), a triangle (three segments), a hexagonal-shaped cylinder (six segments), etc. Other polygonal shapes may also be possible.

The convex aspect in embodiments of the first external face may especially refer to the fact that the first external face may be convex around the axis of elongation or another axis parallel to the axis of elongation. Hence, parallel to the axis of elongation the first external face may essentially be planer. In other words, the first external face, whether or not consisting of more than one segment, may be configured essentially parallel to the axis of elongation.

Therefore, in embodiments the first external face has a cross-sectional shape selected from triangular, square, pentagonal, hexagonal, heptagonal, octagonal, polygonal having more than 8 faces, oval, and round. The same may thus apply to the (overall) shape of the second external face. Likewise, the same may apply the (overall) shape of the chamber. Further, the second external face may define a cavity circumferentially enclosed by the vapor chamber.

When using such a vapor chamber, the lighting device may be relatively light-weight while nevertheless heat can be transported away from the light source(s) to the (optional) heat sink. The use of the vapor chamber also allows using a hollow support for the light source(s). Hence, a hollow support may be provided by the (shaped) vapor chamber. This also allows a relatively light-weight support for the one or more light sources while nevertheless heat can be transported away from the light source(s) to the (optional) heat sink. Thus the architecture is relatively light-weight while nevertheless heat can be transported away from the light source(s) to the heat sink in an efficient way. Further, this may also allow positioning light sources at different positions on the (light-weight) support for creating the desired beam shape and/or for creating an essentially omni-directional light source. Hence, in this way a (retrofit) HID-type LED lighting device may be provided. Further, this may also allow protection for component(s) which may be arranged in said (shaped) vapor chamber.

In specific embodiments, the vapor chamber unit has a cross-sectional shape that is cylindrical. In such embodiments, the first plate and the second plate may be configured as cylinders (as also described above).

In many of the above embodiments, the term "convex" or the convex aspect of the first external face of the vapor chamber is especially explained in relation to closed cross-sectional shapes, such as a (hexagonal) cylinder, or a triangle, a square, etc. However, also embodiments may be possible wherein e.g. the cylinder is not completely round, but part of the cylinder (parallel to the axis of elongation) is missing. For instance, a triangular cross-section without one of the sides, or a square cross-section without one of the sides, or a hexagonal cross-section without 1-3 of the six sides, etc. Therefore, in embodiments the first external face has a cross-sectional shape which is not closed (like e.g. a semi-circle or similar to a horseshoe), and wherein the second external face defines a cavity partly circumferentially enclosed by the vapor chamber.

In specific embodiments, the light sources may only be available on part of the vapor chamber unit. This allows that part of the vapor chamber unit receives the thermal energy, which then via the vapor chamber is transported to another (more remote from the light sources) part, wherein no light sources are available. At that other part, the vapor in the chamber may cool, and thermal energy may be dissipated. Especially, this other part may be in thermal, such as physical, contact with the heat sink. As indicated above, the heat sinks may comprise heat sink fins. Hence, the heat sink fins may be in thermal, such as physical, with the vapor chamber unit at the other part thereof.

Therefore, in specific embodiments all light sources may be configured at a second distance (L2) from the second end independently selected from the range of at least 0.2*L1, such as at least 0.3*L1, like at least 0.4*L1. Here, the phrase "independently selected" refers to the embodiments wherein all light sources have a distance selected from afore-mentioned range, though the respective distances may mutually differ.

As indicated above, the light source(s) are especially associated to the convex first external face, either directly or via a printed circuit board.

In specific embodiments, the lighting device comprises at least two solid state light sources, such as at least four, like at least eight light sources. When the first external face is segmented, such as in the case of the first external face having a polygonal cross-section, each segment may comprise one or more solid state light sources attached thereto. However, in other embodiments not all segments may comprise one or more solid state light sources, especially a plurality, attached thereto. For instance, up to 50% of the segments may comprise one or more solid state light sources attached thereto. As indicated above, in other embodiments one or more segments may comprise one or more solid state light sources, especially a plurality, attached thereto, but only over part of their surface, such that all light sources have a distance of at least 0.2*L1 from the second end.

In embodiments, one or more light sources, especially a plurality, have optical axis perpendicular to a mutual axis. In specific embodiments, one or more light sources, especially a plurality, have optical axis perpendicular to the axis of elongation. In yet further specific embodiments, two or more light sources have optical axes having mutual angles unequal to 0°. For instance, a plurality of light sources may provide optical axes wherein the two most extreme have a mutual angle selected from the range of 90-180°. In yet further embodiments, a plurality of light sources may provide optical axes distributed, especially evenly distributed, over 360° (around an axis, especially the axis of elongation).

For instance, in the case of a hexagonal cross-section of the first external face, each of the six segments may comprise one or more solid state light sources, especially a plurality, attached thereto. In other embodiments, however, in the case of a hexagonal cross-section of the first external face, only three (adjacent) segments of the six segments may comprise one or more solid state light sources, especially a plurality, attached thereto.

For instance, the heat sink may be configured at the second end of the vapor chamber (unit). Hence, in embodiments the heat sink is configured closer to the second chamber end than to the first chamber end.

As indicated above, the heat sink may comprise a plurality of heat sink fins. In embodiments, the heat sink may essentially consist of a plurality of heat sink fins.

In specific embodiments, one or more of the heat sink fins are configured in the cavity as defined above. The heat sink fins may have different dimensions, to accommodate to the cavity.

Alternatively or additionally, one or more of the heat sink fins are configured at the second end. For instance, in embodiments heat sink fins may be available at the area of the first external surface defined by at maximum 0.4*L1, like at maximum 0.3*L1, such as at maximum 0.2*L1 from the second end.

In further specific embodiments, the vapor chamber unit and the heat sink fins are a monolithic body.

Alternatively or additionally, the lighting device may further comprise a cooling element, configured to (actively) cool the vapor chamber unit. The cooling element may e.g. be selected from the group consisting of a ventilator, a synjet cooler, a piezo cooler, a Peltier element, etc. Synjet cooling (such as from Aavid Thermacore-Boyd Corporation) may especially be based on: an oscillating diaphragm creating pulses of high velocity turbulent air flow; a high velocity flow entrains or pulls air in its wake increasing overall air flow, in embodiments by as much as 5 times; and the turbulent air flow improves the heat transfer out of the heat sink, while the entrained air sweeps the hot air out of the system, thus cooling more efficiently. Hence, in specific embodiments the cooling element may be configured to generate a gas flow (such as a flow of air) along the second external face. Hence, in specific embodiments the cooling element may be configured to provide a gas flow to the cavity or through the cavity. Especially, when the cavity is hollow, and surrounded by the second external face, a gas flow may be used to further cool. As indicated above, in embodiments one or heat sink fins may be configured within the cavity.

The light source(s) may be functionally coupled to electronics, such as e.g. a ballast, etc. Alternatively or additionally, the cavity may also be used to host at least partly electronics. Therefore, in embodiments the lighting device may further comprise electronics, wherein at least part of the electronics is configured in the cavity (as defined above). The electronics may also essentially entirely be configured within the cavity. For instance, a driver for the (solid state) light source(s) may at least partly be configured in the cavity.

In embodiments, the term "vapor chamber" may refer to a plurality of vapor chambers. In embodiments, they may all comply with one or more, especially all, of the herein indicated features in relation to the vapor chamber.

In specific embodiments, the heat sink may comprise a separate second vapor chamber ("further vapor chamber"). Such separate second vapor chamber may not be in gaseous communication with the vapor chamber. Alternatively, the second vapor chamber is in gaseous communication with the vapor chamber. In specific embodiments, a monolithic body provides both the vapor chamber and the second vapor chamber, wherein in variants the vapor chambers are in gaseous communication or in other variants are not in gaseous communication.

Hence, in an aspect, the invention provides a heat sink comprising a vapor chamber.

In specific embodiments, a heat sink fin may comprise a separate third vapor chamber. Such separate third vapor chamber may not be in gaseous communication with the vapor chamber. Alternatively, the third vapor chamber is in gaseous communication with the vapor chamber. In specific embodiments, a monolithic body provides both the vapor chamber and the third vapor chamber, wherein in variants the vapor chambers are in gaseous communication or in other variants are not in gaseous communication. In yet further embodiments, the third vapor chamber may be in gaseous communication with the optional second vapor chamber.

Hence, in an aspect, the invention provides a heat sink fin comprising a vapor chamber.

In specific embodiments, at least part of the electronics is configured in electronics part, functionally coupled to the vapor chamber unit. In yet further specific embodiments, such electronics part comprises a separate fourth vapor chamber. Such separate fourth vapor chamber may not be in gaseous communication with the vapor chamber. Alternatively, the fourth vapor chamber is in gaseous communication with the vapor chamber. In specific embodiments, a monolithic body provides both the vapor chamber and the fourth vapor chamber, wherein in variants the vapor chambers are in gaseous communication or in other variants are not in gaseous communication. In yet further embodiments, the fourth vapor chamber may be in gaseous communication with the optional second vapor chamber.

The lighting device may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, (outdoor) road lighting systems, urban lighting systems, green house lighting systems, horticulture lighting, etc.

Especially, the lighting device may be part of or may be applied in (outdoor) road lighting systems. The term "street lighting" refers at least to (outdoor) road lighting. However, (also other) applications may be possible, such as e.g. high-way lighting, pedestrian walk lighting, wall wash applications, parking garage lighting, outdoor parking lighting, gas station lighting. Yet other applications may include automotive lighting or retail lighting. The invention may in aspects be applied to bulbs, spots, point sources, high lumen products, lighting modules, consumer lamps, professional lamps, stadium lighting, high-bay or low-bay lighting, high power electronics, oil industry lighting, gas industry lighting, harsh environment type of application, etc.

In yet a further aspect, the invention also provides a module comprising a reflector and the lighting device as defined herein, wherein the reflector is configured to redirect at least part of the light source light. In yet further specific embodiments, the reflector partly circumferentially surrounds the lighting device. Also here, the term "circumferentially" does not necessarily imply round or circular, but may also refer to a segmented shape that surrounds (partly) the lighting device. Reflectors for e.g. street lighting luminaires are known in the art.

In yet a further aspect, the invention also provides a luminaire, such as a street lighting luminaire, comprising the module as defined herein. In yet further specific embodiments, the street lighting luminaire comprises a pole. In other embodiments, the luminaire may comprise a mounting system, e.g. for floodlight applications. A floodlight may be defined as a broad-beamed, high-intensity artificial light. Floodlight may be used to illuminate e.g. outdoor playing fields, stage lighting etc.

Hence, in an aspect instead of a heat sink, heat pipe and thermal potting materials, a vapor chamber may be applied. Amongst others, it is herein suggested to have a vapor chamber with fins as a monolithic part. The vapor chamber may be free form, e.g. cylindrical. A vapor chamber with heat sink fins (as a monolithic part) may effectively replace a heat sink, or a combination of a heat pipe and thermally coupled heat sink.

In embodiments, the wall of the vapor chamber may be thin, e.g. less than 1 mm (see also above). In embodiments, a driver can be integrated or embedded in the vapor chamber unit. Alternatively or additionally, the inner side if the vapor chamber (herein also indicated as cavity), may comprise a heat sink structure, as heat sink fins may be configured in this cavity (see also above).

Amongst others, the invention may solve the problem that prior art lighting devices may be relatively heavy and/or the problem that the driver may not be cooled without the help of thermal potting materials.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1A:
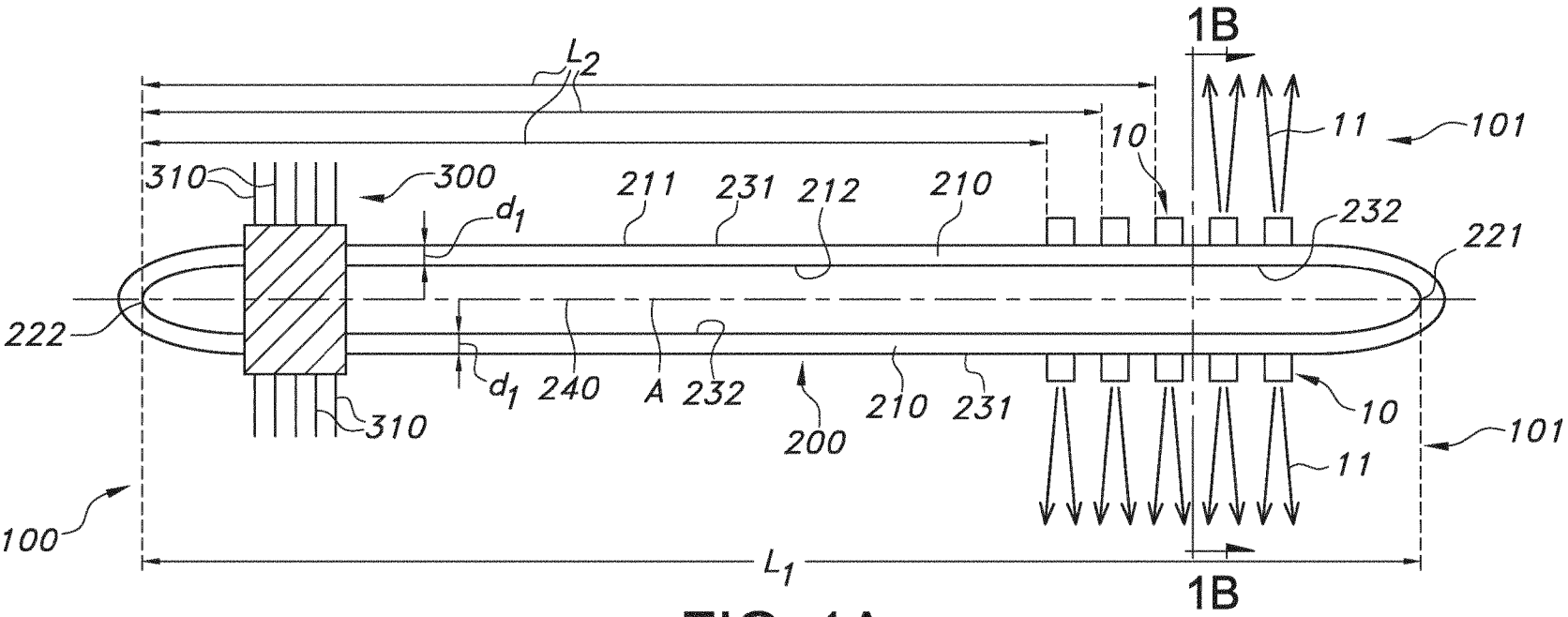
FIGS. 1*a*-1*d* schematically depict some embodiments and variants of the lighting device.
Figure 1C:
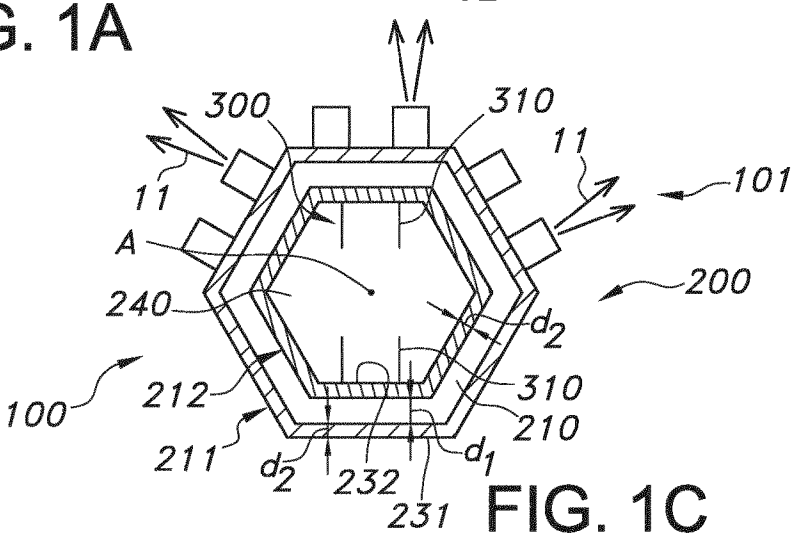
Figure 1B:
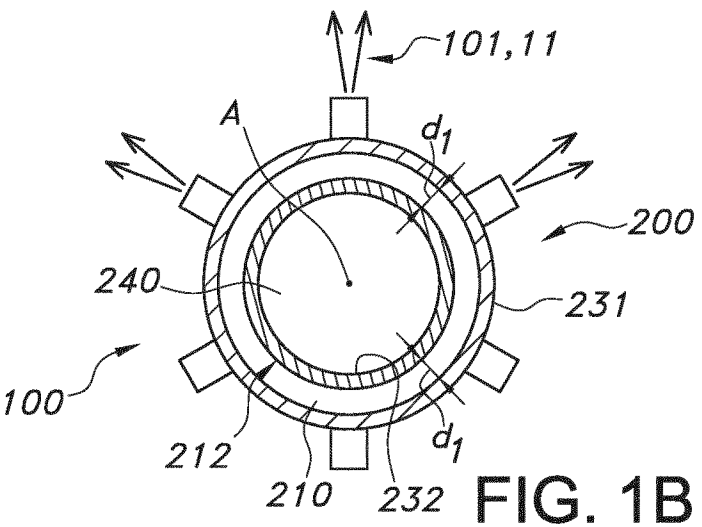

FIGS. 1*a*-1*b* schematically depict an embodiment of a lighting device 100 comprising a vapor chamber unit 200 and one or more light sources 10. Here, a plurality of light sources 10 is schematically depicted. The plurality of light sources 10 comprises solid state light sources.

Further, the lighting device 100 may optionally comprise a heat sink 300 (which is also depicted in FIG. 1*a*). Here, schematically the heat sink 300 is depicted at (or close to) one of the ends of the vapor chamber unit.

The vapor chamber unit 200 comprises a vapor chamber 210. This vapor chamber 210 is especially defined by at least a first plate 211 and a second plate 212. These plates 211,212 have an average plate distance d1. In embodiments, the average plate distance d1 may be selected from the range of 50 μm-5 mm. The first plate 211 and a second plate 212 may each have a second thickness d2 independently selected from the range of 50-5000 μm, such as 300-2000 μm. The first plate 211 and a second plate 212 comprise a material selected from the group consisting of aluminum, copper, and (stainless) steel. The vapor chamber 210 may comprise wick material (not depicted).

The vapor chamber 210 comprises a first chamber end 221 and a second chamber end 222 defining a chamber length L1. The chamber length L1 and the average plate distance d1 may e.g. have a ratio selected from the range of L1/d1≥10. Note that the optional heat sink 300 is configured closer to the second end than to the first end, and the light sources are configured closer to the first end than to the second end in this schematically depicted embodiment. However, other variants may also be possible.

Further, the vapor chamber unit 200 comprises a first external face 231 defined by at least part of the first plate 211. The vapor chamber unit 200 also comprises a second external face 232 defined by at least part of the second plate 212. Here, in this schematically depicted embodiment the first external face 231 is convex.

As schematically depicted, the heat sink 300 is thermally coupled to the vapor chamber unit 200.

The light sources 10 are configured to generate light source light 11. The light sources 10 are associated with the first external face 231. The lighting device 100 is configured to generate lighting device light 101, which may essentially consist of the light source light 11 (of the light source(s) 10). For instance, the light sources may be available on a PCB or may be available in the form of LED strip (PCB or strip not depicted); though other options may also be possible.

The first external face 231 may have a cross-sectional shape selected from triangular, square, pentagonal, hexagonal (see FIG. 1*c*), heptagonal, octagonal, oval, and round (see FIG. 1*b*). Here, the cross-sectional shape is e.g. round (see FIG. 1*b*). The cross-sectional shape is especially the cross-section perpendicular to an axis of elongation A. Further, the second external face 232 here defines a cavity 240 circumferentially enclosed by the vapor chamber 210. This cavity 240 may optionally be used in several ways, see further below.

Hence, the embodiment schematically depicted in FIGS. 1*a*-1*b* is of a vapor chamber unit 200 having a cross-sectional shape that is cylindrical. However, other shapes are also possible (see FIG. 1*c*).

In FIG. 1*a*, an embodiment is schematically depicted wherein all light sources 10 are configured at a second distance L2 from the second end 222 independently selected from the range of at least 0.2*L1.

In FIG. 1*a*, also an embodiment is schematically depicted wherein the heat sink 300 is configured closer to the second chamber end 222 than to the first chamber end 221.

Further, the (optional) heat sink 300 may comprise a plurality of heat sink fins 310.

In FIG. 1*a*, the cavity 240 seems to be closed (essentially due to a closed second external surface 232). This is however not necessarily the case, see e.g. also FIGS. 1*d* and 2*a*.

FIG. 1*c* schematically depicts an embodiment wherein the cross-sectional shape of the first external face is not round, but hexagonal shaped. Further, though not limited to this specific hexagonal shaped embodiment, FIG. 1*c* schematically depicts an embodiment wherein one or more of the heat sink fins 310 are configured in the cavity 240.

In above embodiments, a variant may be wherein the vapor chamber unit 200 and the heat sink fins 310 are a monolithic body.

Figure 1D:
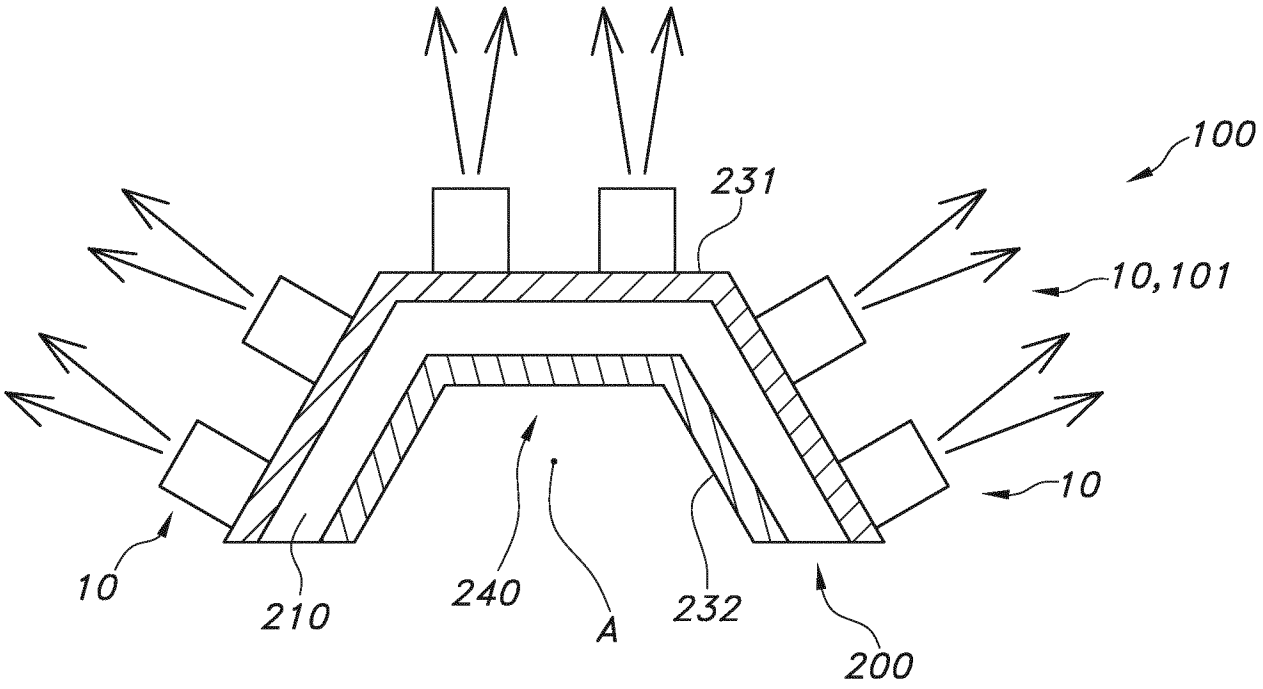

FIG. 1*d* schematically depicts an embodiment of the lighting device 100 wherein the first external face 231 has a cross-sectional shape which is not closed. The second external face 232 defines a cavity 240 partly circumferentially enclosed by the vapor chamber 210. FIG. 1*d* schematically depicts an embodiment of e.g. a hexagonal cross-section (of the first external face 231, or the second external face 232, or the vapor chamber 210) without 1-3 of the six sides.

Figure 2A:
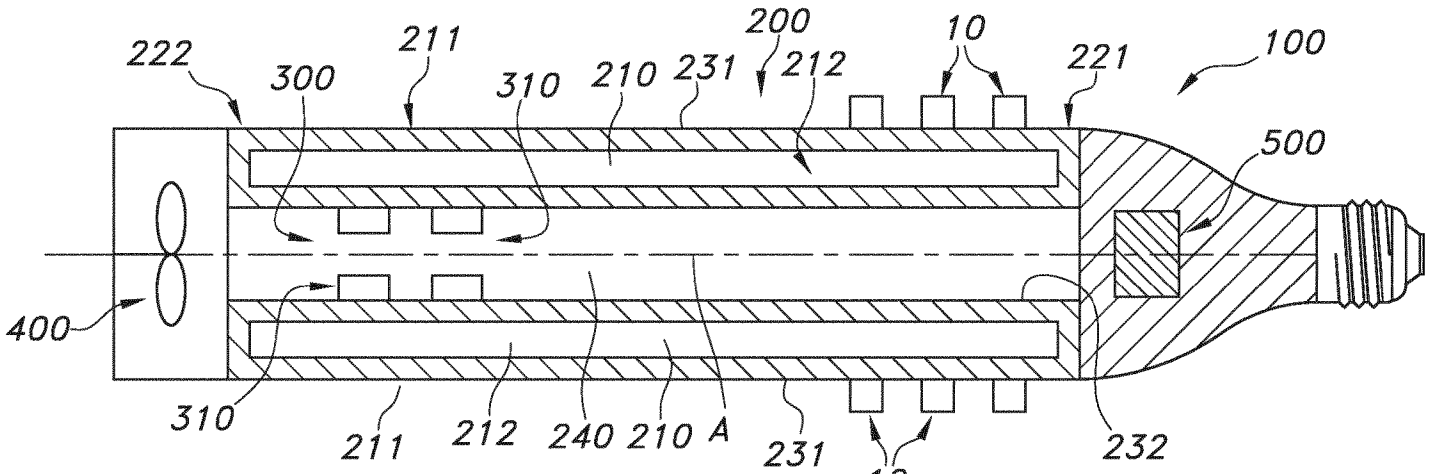
FIGS. 2*a*-2*b* schematically depict some further embodiments and variants.

FIG. 2*a* schematically depicts an embodiment of the lighting device 100, further comprising a cooling element 400. The cooling element 400 is especially configured to cool the vapor chamber unit 200. Schematically, an embodiment is depicted wherein the cooling element 400 is configured to generate a gas flow along the second external face 232, such as a fan. Also here, by way of example a variant is depicted wherein optionally the vapor chamber unit 200 and the heat sink fins 310 are a monolithic body. Note that of course also heat sink fins 310 may be available at the first external face 231, as embodiments may be combined (see also below).

Reference 500 refers to electronics, e.g. to drive the light source(s) 10. Further, by way of example an Edison type screw is depicted.

Figure 2B:
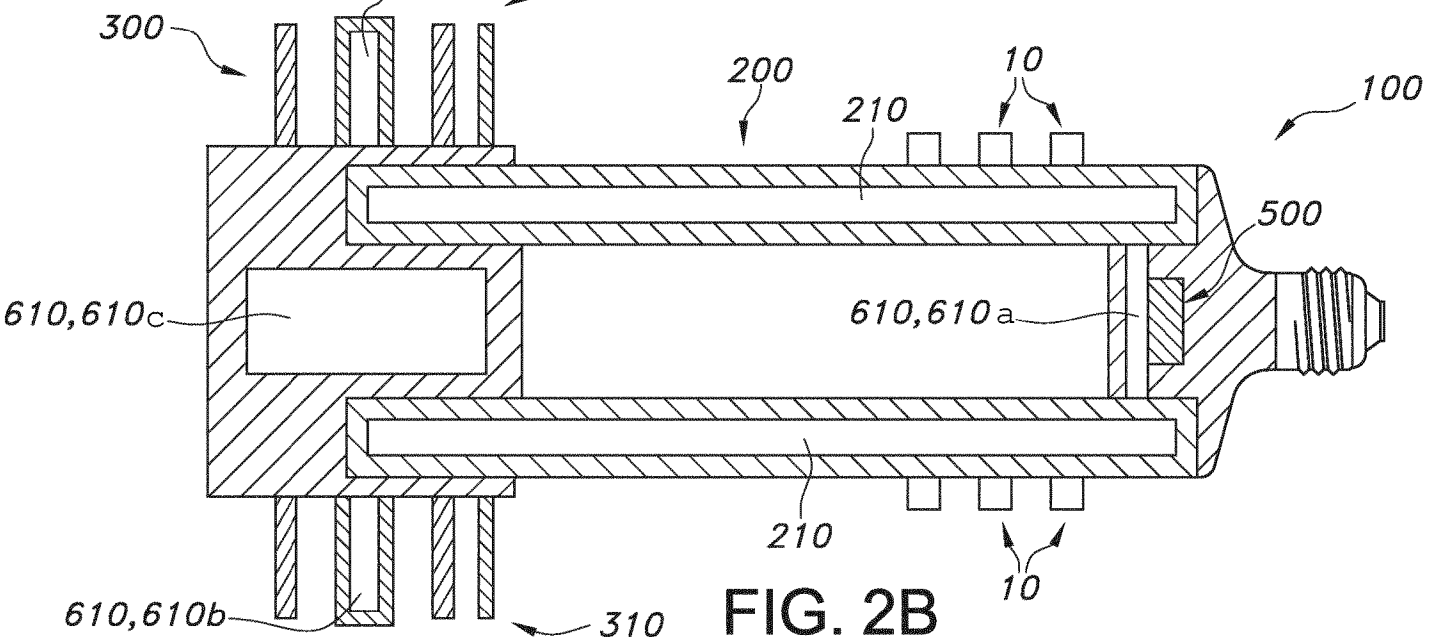

Like in the other Figures, FIG. 2*b* schematically depicts a number of embodiments and variants in a single Figure. This does not necessarily imply that all elements depicted are necessarily available in a single embodiment. Elements may also be combined with other embodiments herein schematically depicted or herein described.

FIG. 2*b* schematically depicts an embodiment further comprising electronics 500, wherein at least part of the electronics 500 is configured in the cavity 240. Further, by way of example a further vapor chamber 610 is available. Reference 610*a* shows such further vapor chamber, which may be used to guide away thermal energy of the electronics 500 and/or of the light sources 10.

FIG. 2*b* also schematically depicts an embodiment of the heat sink 300, comprising a cavity wherein the vapor chamber unit 200 is partly configured. Further, by way of example one or more of the heat sink fins 310 may alternatively or additionally comprise a further vapor chamber 610. This alternative or additional further vapor chamber 610 is indicated with reference 610*b*.

The heat sink 300 may comprise a massive body, which may alternatively or additionally comprise a further vapor chamber 610 (not comprised by the heat fins 310), indicated with reference 610*c*.

Here, the further vapor chambers 610 are not in communication with the vapor chamber 210. However, in alternative embodiments a further vapor chamber 610 may also in gaseous communication with the vapor chamber 210.

Figure 3:
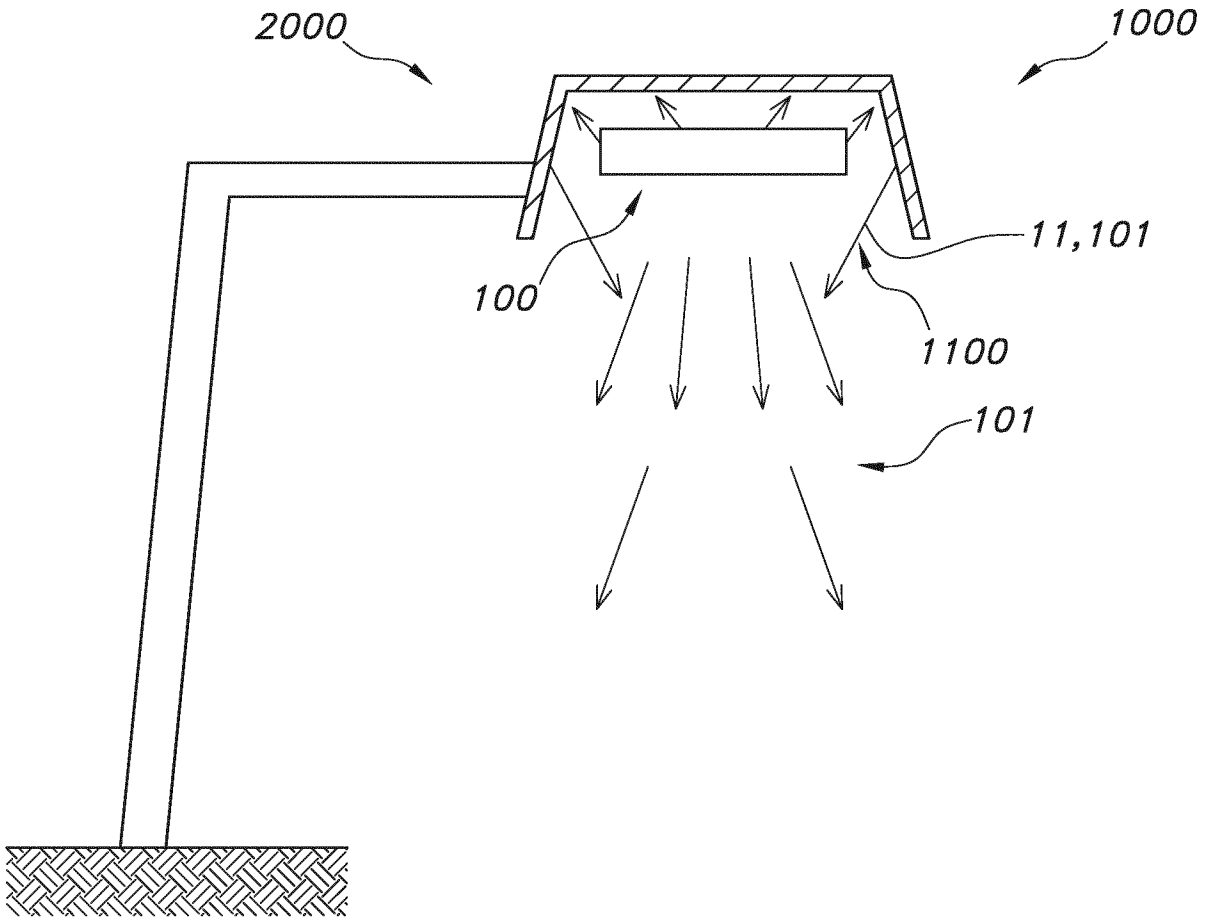
FIG. 3 schematically depict some further aspects.

FIG. 3 schematically depicts an embodiment of a module 1000 comprising a reflector 1100 and the lighting device 100. The reflector 1100 partly circumferentially surrounds the lighting device 100. Especially, the reflector 1100 is configured to redirect at least part of the light source light 11. FIG. 3 also schematically depicts a street lighting luminaire 2000 comprising the module 1000. Here, by way of example the street lighting luminaire 2000 comprises a pole.

Simulations were executed with the vapor chamber. It was in this way experimentally showed that the light sources may be operated at a lower temperature as more heat is dissipated. This may prolong the lifetime of the light sources. Further, the weight of the lighting device may be lower due to the vapor chamber(s) which reduce weight, relative to variants without such vapor chamber.

The term "plurality" refers to two or more.

The terms "substantially" or "essentially" herein, and similar terms, will be understood by the person skilled in the art. The terms "substantially" or "essentially" may also include embodiments with "entirely", "completely", "all", etc. Hence, in embodiments the adjective substantially or essentially may also be removed. Where applicable, the term "substantially" or the term "essentially" may also relate to 90% or higher, such as 95% or higher, especially 99% or higher, even more especially 99.5% or higher, including 100%.

The term "comprise" includes also embodiments wherein the term "comprises" means "consists of".

The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices, apparatus, or systems may herein amongst others be described during operation. As will be clear to the person skilled in the art, the invention is not limited to methods of operation, or devices, apparatus, or systems in operation.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim.

Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

The article "a" or "an" preceding an element does not exclude the presence of a plurality of such elements.

The invention may be implemented by means of hardware comprising several distinct elements, and by means of a suitably programmed computer. In a device claim, or an apparatus claim, or a system claim, enumerating several means, several of these means may be embodied by one and the same item of hardware. The mere fact that certain measures are recited in mutually different dependent claims does not indicate that a combination of these measures cannot be used to advantage.

The invention also provides a control system that may control the device, apparatus, or system, or that may execute the herein described method or process. Yet further, the invention also provides a computer program product, when running on a computer which is functionally coupled to or comprised by the device, apparatus, or system, controls one or more controllable elements of such device, apparatus, or system.

The invention further applies to a device, apparatus, or system comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting device comprising a vapor chamber unit, a heat sink, and a plurality of light sources, wherein:

the vapor chamber unit comprises a vapor chamber defined by at least a first plate and a second plate having an average plate distance (d1) between the first plate and the second plate, wherein the vapor chamber comprises a first chamber end and a second chamber end defining a chamber length (L1), wherein the vapor chamber unit comprises (i) a first external face defined by at least part of the first plate, wherein the first external face is convex, and (ii) a second external face defined by at least part of the second plate;

the heat sink is thermally coupled to the vapor chamber unit; and the light sources are configured to generate light source light, and wherein the light sources are associated with the first external face, wherein the first external face has a cross-sectional shape selected from triangular, square, pentagonal, hexagonal, heptagonal, octagonal, polygonal having more than 8 faces, oval, and round, and wherein the second external face defines a cavity circumferentially and completely enclosed by the vapor chamber.

2. The lighting device according to claim 1, wherein the vapor chamber unit has a cross-sectional shape that is cylindrical.

3. The lighting device according to claim 1, wherein the average plate distance (d1) is selected from the range of 50 μm-5 mm, wherein the first plate and the second plate comprise a material selected from the group consisting of aluminum, copper, and steel, wherein the first plate and a second plate each have a second thickness independently selected from the range of 50-5000 μm, wherein the chamber length (L1) and the average plate distance (d1) have a ratio selected from the range of L1/d1≥10, and wherein the plurality of light sources comprises solid state light sources.

4. The lighting device (according to claim 1, wherein all light sources are configured at a second distance from the second end independently selected from the range of at least 0.2*L1.

5. The lighting device according to claim 1, wherein the heat sink is configured closer to the second chamber end than to the first chamber end.

6. The lighting device according to claim 1, wherein the heat sink comprises a plurality of heat sink fins.

7. The lighting device according to claim 6, wherein one or more of the heat sink fins are configured in the cavity.

8. The lighting device according to claim 6, wherein the vapor chamber unit and the heat sink fins are a monolithic body.

9. The lighting device according to claim 1, further comprising a cooling element, configured to cool the vapor chamber unit.

10. The lighting device according to claim 9, wherein the cooling element is configured to generate a gas flow along the second external face.

11. The lighting device according to claim 1, further comprising electronics, wherein at least part of the electronics is configured in the cavity according to claim 1.

12. The lighting device according to claim 1, wherein the light sources are associated to a flexible PCB which is associated to the first external face.

13. The lighting device according to claim 12, wherein the flexible PCB comprises a metal carrier, wherein the metal carrier is soldered to the first external face.

14. A module comprising a reflector and the lighting device according to claim 1, wherein reflector partly circumferentially surrounds the lighting device, and wherein the reflector is configured to redirect at least part of the light source light.

15. A street lighting luminaire comprising the module according to claim 14, wherein the street lighting luminaire comprises a pole.

* * * * *